US009117372B2

(12) United States Patent
Köth

(10) Patent No.: US 9,117,372 B2
(45) Date of Patent: Aug. 25, 2015

(54) TRANSPORTATION SYSTEM ARRIVAL AND DEPARTURE TIME CALCULATION AND DISPLAY SYSTEM

(71) Applicant: LAWO Informationsysteme GmbH, Rastatt (DE)

(72) Inventor: Karsten Daniel Köth, Karlsruhe (DE)

(73) Assignee: Lawo Informationssysteme GMBH, Rastatt (DE)

( * ) Notice: Subject to any disclaimer, the term of this patent is extended or adjusted under 35 U.S.C. 154(b) by 69 days.

(21) Appl. No.: 13/787,245

(22) Filed: Mar. 6, 2013

(65) Prior Publication Data

US 2013/0234868 A1 Sep. 12, 2013

(30) Foreign Application Priority Data

Mar. 8, 2012 (EP) ..... 12158648

(51) Int. Cl.

*G08G 1/123* (2006.01)
*G08G 1/127* (2006.01)
*G08G 1/133* (2006.01)
*G08G 1/01* (2006.01)

(52) U.S. Cl.

CPC ..... *G08G 1/123* (2013.01); *G08G 1/127* (2013.01); *G08G 1/133* (2013.01); *G08G 1/0112* (2013.01); *G08G 1/0129* (2013.01)

(58) Field of Classification Search

CPC ..... G08G 1/123
USPC ..... 340/988, 994, 993; 701/117, 468, 201, 701/209
See application file for complete search history.

(56) References Cited

U.S. PATENT DOCUMENTS

| | | | | |
|---|---|---|---|---|
| 4,365,273 | A * | 12/1982 | Yamada et al. | 382/299 |
| 5,739,774 | A | 4/1998 | Olandesi | |
| 6,006,159 | A | 12/1999 | Schmier et al. | |
| 6,037,881 | A * | 3/2000 | Bornhauser et al. | 340/994 |
| 6,374,176 | B1 | 4/2002 | Schmier et al. | |
| 6,700,506 | B1 | 3/2004 | Winkler et al. | |
| 2002/0055818 | A1 | 5/2002 | Gaspard, II | |
| 2002/0099500 | A1 | 7/2002 | Schmier et al. | |
| 2007/0112509 | A1 * | 5/2007 | Kikuchi et al. | 701/209 |
| 2012/0010803 | A1 | 1/2012 | Min et al. | |
| 2013/0096969 | A1 * | 4/2013 | Karanicolas | 705/7.13 |
| 2014/0046585 | A1 * | 2/2014 | Morris et al. | 701/468 |

* cited by examiner

*Primary Examiner* — Brent Swarthout
(74) *Attorney, Agent, or Firm* — Howison & Arnott, LLP

(57) ABSTRACT

A system and method collects transit vehicle arrival and departure data sent from the transit vehicle to a stationary control center. The stationary control center continuously calculates, a medial time table, a medial travel time to a destination on a transit route and a medial travel time between transit stops on the route. The medial values may be calculated differently for rush hour, holiday, or certain weather conditions to increase the accuracy of the schedule forecast. Actual position and time information of a transit vehicle may be transmitted via wireless communication from a transit vehicle to the stationary control center. The position and time information is transmitted at least when the transit vehicle arrives and departs each transit stop on the transit route. The medial values can be displayed to transit vehicle users.

28 Claims, 3 Drawing Sheets

| Time | VEHICLE CONTROL UNIT | Vehicle | INFOTAINMENT SYSTEM | CONTROL CENTER |
|---|---|---|---|---|
| T01 | | Start engine | | |
| T02 | Booting... | | Booting... | all time up |
| T03 | Destination name → transmit to → | | IS | |
| T04 | | | Show destination | |
| T05 | Next stop name → transmit to → | | IS | |
| T06 | | | Show next stop | |
| T07 | | Door open → transmit to → | IS | |
| T08 | | | Telegram actPos → transmit to → | CC |
| T09 | | | | Calculate actual time tables |
| T10 | | | IS ← transmit to ← | actual time table |
| T11 | | | Show actual departure time | |
| T12 | | Door close → transmit to → | IS | |
| T13 | | | Telegram actPos → transmit to → | CC |
| T14 | | | | Calculate actual time tables |
| T15 | | | IS ← transmit to ← | actual time table |
| T16 | Next stop name → transmit to → | | IS | |
| T17 | | | Show next stop | |
| T18 | | | Show actual arrival time for next stop and actual transfer information for next stop | |

*FIG. 3*

TRANSPORTATION SYSTEM ARRIVAL AND DEPARTURE TIME CALCULATION AND DISPLAY SYSTEM

CROSS REFERENCE

This application claims benefit of European Patent Application No. 12158648.1, filed Mar. 8, 2012, entitled TRANSPORTATION SYSTEM ARRIVAL AND DEPARTURE TIME CALCULATION AND DISPLAY SYSTEM.

TECHNICAL FIELD

Embodiments of the present invention relate generally to scheduling systems for public transit vehicles.

BACKGROUND

Transportation systems that exist in most cities often provide transportation schedules for their buses, trams, trains, trolleys or other public transportation systems. The time schedule published by a transportation system provider provides a schedule indicating arrival and departure times of vehicles for the various transportation system routes. Sometimes a transportation system route may be called a transportation line. Even in the best of conditions, it can be difficult for a transportation vehicle operator to maintain the written schedule, particularly during peak traffic times, for reasons such a traffic conditions, weather conditions, passenger load and vehicle malfunctions. Furthermore, no matter how close a bus driver or vehicle operator is able to maintain the written schedule, a passenger who uses the public transit system or a particular transit line infrequently, or perhaps a passenger from outside of the transit area in which the particular transit vehicle operates, is unlikely to have a schedule readily available and know what the expected transit schedule arrival and departure times for each destination should be.

A passenger waiting at a transit stop for a transit vehicle does not know when the next transit vehicle will arrive at the particular stop. For example, if a passenger arrives at a particular stop a minute before the scheduled arrival time, and the transit vehicle does not arrive at the scheduled time, the passenger does not know if he arrived before or after the scheduled time and further does not know whether the transit vehicle will arrive at that particular stop at all. This consumes a passenger's time, which essentially extends the duration of what may already be a long journey in inclement weather. Such time may have been better spent by the passenger doing something else rather than waiting for the next transit vehicle. If a passenger uses a commuter bus at peak hours, a waiting passenger may be relatively certain that a vehicle will arrive on or almost on time, but if the passenger could determine if the bus was going to be late, the passenger could have stayed at their office or perform additional work prior to walking to the bus station to wait for a bus that is going to be late. Furthermore, if a passenger wants to make a transfer from one transit line to a second transit line, it would be advantageous for the passenger to know if the transit line thereon will arrive at a transfer stop in time for the transit vehicle on the second line to pick them up.

Additionally, an enormous amount of effort and man hours go in to determining a bus route schedule that includes arrival and departure times for each stop on a transit line. After determining the arrival and departure times for each stop on a transit line, these arrival and departure times must be entered by a person into a database. A database may even be used or loaded into a transit vehicle's electronics so as to inform the driver as well as the passengers, via display signs, the transit line or route number, the next stop (e.g., market street), and the expected arrival time at the next stop. If a bus is operating behind schedule, these times may not be properly adjusted to coincide with the transit vehicles actual arrival and departure times for the transit stops. Such a situation adds additional confusion to the passengers riding on or waiting for a transit vehicle and further may add stress to the transit vehicle operator or a bus driver due to the knowledge that they are running behind schedule and perhaps creating additional hardships for passengers who are attempting to transfer from one transit line to another.

What is needed is a real-time, self-learning transit stop schedule creation system and method that learns and stores transit stop arrival and departure times so as to create a flexible estimated schedule that may be electronically distributed to transit system users in real or near real time as well as displayed to transit system passengers on the bus or transit vehicle and other locations in order to help eliminate the drawbacks of the prior human inputted hard schedule that a transit vehicle driver is constantly attempting to meet regardless of the traffic conditions, weather, passenger load, day of the week or other variables that effect the timeliness of a transit vehicle's arrival and departure time at each stop on its particular transit route or line.

SUMMARY

An exemplary system and method is provided that collects data including transit stop arrival and departure data sent from a transit vehicle to a stationary control center. The stationary control center continuously calculates, using the data provided, a medial time table and medial travel time to a next transit stop for the transit vehicle on the predetermined route. A complete and accurate route schedule can be created without manual input or calculations from service staff. The medial values may be calculated differently for different conditions, such as rush hour conditions, weekend conditions, bad weather conditions or holiday conditions, to increase the accuracy of the route schedule forecast. Actual position and time information of a particular transit vehicle may be transmitted via wireless communication from a transit vehicle mounted device to the stationary control center. Such transmission of actual position and time information from a transit vehicle is transmitted e.g. when the transit vehicle arrives and departs each of the predetermined stops on the particular route that the transit vehicle is operating on. If the actual position of the transit vehicle differs from the established medial time table for the particular transit vehicle route, the difference and the resulting arrival and departure times will be transmitted to all relevant passenger information displays so that transit vehicle patrons can be made aware of the changed arrival and departure times for the various transit vehicle stops on the particular route for that particular day or time period. Manual input from service staff is not required as exemplary embodiments of this system and method are completely independent and substantially automated.

An embodiment provides a method for providing a transit stop forecast in a self-learning transit system comprising a control center and a transit vehicle unit adapted to be installed into a transit vehicle travelling on a transit route, wherein the transit route comprises a plurality of transit stops. The method comprises a) providing a position information item of the transit vehicle unit to the control center; b) storing the position information item in a memory device of the control center; c) repeating steps (a) and (b) until a predetermined number of position information items have been stored; d)

calculating by the control center a medial time table for each of the transit stops based on the stored position information items and storing the medial time table in the memory device; and e) providing the medial time table to the transit vehicle unit as the transit stop forecast.

According to the inventive method, a self-learning transit system is created, which does not require any manual input from service staff since all the arrival and/or departure times are learned in a self-learning process. Steps (a), (b) and (c) of the method constitute a first phase of the self-learning process. During the first phase position information items are collected, until a sufficient number of position information items are available to provide a first transit stop forecast. A predetermined number of position information items are necessary, since the arrival and/or departure times are forecasted based on the highest probabilities.

In a further embodiment, the steps (a), (b), (d) and (e) are repeated after the predetermined number of position information items have been stored.

After enough position information items have been collected in order to provide the first transit stop forecast, a second learning phase is started within the self-learning transit system. This second phase can basically run during the complete life cycle of the self-learning transit system. During the second phase the control center calculates a new medial time table each time a position information item is received. As a result, the medial time table gets more reliable over time.

In an additional embodiment, the learning phases can be sped up by transmitting a given time table during the first learning phase. In this embodiment, it is not necessary to travel with the transit vehicle through a city, collect the data for every route and transmit the real arrival and/or departure times to the control center until a sufficient number of position information items are collected to provide a first transit stop forecast. Due to this feature, the first learning phase is shortened.

In an additional embodiment, the position information item comprises the actual time and date and/or a transit stop name.

By providing the actual time and transit stop name to the control server, it is possible to update the medial time table. Besides these data the position information item can also comprise a serial number of the transit vehicle unit, the line and/or route member on which the transit vehicle is operating, a GPS position of the transit vehicle and/or an indication, whether the transit vehicle is arriving or departing from a transit stop.

According to another embodiment, the position information item is provided to the control center, when the transit vehicle arrives and/or departs from each of the transit stops.

By means of this measure, the arrival and departure times can be accurately updated in the medial time table. The departure time of the current stop or the arrival time at the next stop are updated immediately, since an updated medial time table is sent from the control center to the transit vehicle. The updated arrival and/or departure times of the medial time table can then be displayed inside the transit vehicle.

In a further embodiment, the position information item is provided to the control center on predetermined time intervals, when the transit vehicle is traveling along the transit route.

After the position information items are periodically sent to the control center, the arrival and/or departure times are updated in real time. So, when the transit vehicle is in a traffic jam, the display inside the transit vehicle continuously indicates the new arrival and/or departure times.

According to another embodiment, the position information item and/or the medial time table are stored in the memory device of the control center in a double compressed format.

The double compressed format assures that the amount of memory space required to store the medial time table and/or the position information items for each transit route will not grow larger than a predetermined size, even if the system is operated for several years while recording every arrival and departure time at every stop. Additionally, the double compressed format makes sure that a great deviation in time by one position information item does not influence the medial time table.

In an additional embodiment, the control center creates a plurality of databases in the memory device, wherein each position information item is stored in one of the databases dependent on preconfigured conditions, wherein the medial time table is calculated for each database separately and wherein the medial time table provided to the transit vehicle unit is selected dependant on the preconfigured conditions.

The databases can, for example, represent different traffic patterns. By assigning the position information item to the respective database (traffic pattern) and calculating the medial time table for this database, very accurate transit stop forecasts are achieved.

According to another embodiment, the preconfigured conditions comprise a time of day, a day of the week, a date, a holiday flag, a season of the year, an identification of the transit vehicle, an identification of a driver of the transit vehicle, weather conditions and/or road construction data.

In this embodiment, for example, two databases can be created, wherein one database stores the position information items sent for working days (Mondays to Fridays), and wherein the other database stores all the position information items sent for non working days (weekends and/or holidays). Since the traffic patterns for working days and non working days are usually completely different, the arrival and/or departure times for the transit vehicle can be estimated more precisely.

In another aspect of the invention, a self-learning transit system is provided a transit stop forecast for a transit vehicle traveling on a transit route, wherein the transit route comprises a plurality of transit stops. The self-learning transit system comprises a transit vehicle unit adapted to be installed into the transit vehicle and to provide position information items of the transit vehicle unit, and a control center connected to the transit vehicle unit via a wireless communication network and adapted to receive and store the position information items in a memory device comprised by the control center. As soon as a predetermined number of position information items has been stored, the control center is further adapted to calculate a medial time table for each of the transit stops based on the stored position information items, to store the medial time table in the memory device and to provide the medial time table to the transit vehicle unit as the transit stop forecast.

The self-learning transit system collects the position information items sent by the vehicle and continuously calculates (based on these position information items) a medial time table and medial travel times. The transit vehicle unit can, for example, send the position information items via a UMTS (universal mobile telephone system) network to the control center. The self-learning transit system can run completely autonomously. As a result, a manual input of arrival and/or departure times done from the service staff is not necessary.

In another embodiment, the transit vehicle unit is further adapted to provide position information items that comprise the actual time and date and/or a transit stop name.

The actual time transmitted in the position information item can be synchronized with the time base of the control center by means of a NTP (network time protocol) server. This assures an accurate update of the medial time table.

According to another embodiment, the transit vehicle unit comprises a door contact sensor, an odometer and/or a geographical positioning system (GPS) to identify the arrival and/or departure of the transit vehicle from one of the transit stops.

By means of these measures, a precise determination of the transit stop location is achieved.

In a further embodiment, the transit vehicle unit is further adapted to provide the position information items to the control center, when the transit vehicle arrives and/or departs from each of the transit stops.

In conjunction with the door contact sensor, the odometer and/or the geographical positioning system the position information items can be provided to the control center from an exactly determined location of the transit stop. This in turn, leads to a medial time table with a high accuracy. The transit stop forecast is improved.

According to another embodiment, the transit system comprises further transit vehicle units adapted to be installed into further transit vehicles, wherein the control center is further adapted to provide the medial time table to the transit vehicle units operating on the transit route or on different transit routes that intercept with the transit route at a transfer location.

In this embodiment, the updated medial time table is distributed to all or a part of the transit vehicles traveling on the same transit route or traveling on different transit routes that comprise an interception point with the current transit route. This feature is particularly useful for passengers that want to change the transit vehicle at a transfer location. By means of the arrival time of the current transit vehicle and the departure time of the connecting transit vehicle at the respective transfer location, the passenger can figure out if the transfer to the connecting transit vehicle will be successful or not. Thereby, the passenger satisfaction can be improved.

In a further embodiment, the control center is connected to the Internet and further adapted to provide the medial time table to devices connected thereto.

In this embodiment, the passenger can view an updated real time transit stop forecast for the transit vehicle via the Internet. The passenger can access this information on the Internet by means of mobile devices, information pads, computer devices or the like. This feature helps the passengers to better organize and use their time.

In another aspect of the invention, a transit vehicle unit for a self-learning transit system as described above is provided. The transit vehicle unit is adapted to be installed into a transit vehicle traveling on a transit route, wherein the transit route comprises a plurality of transit stops. The transit vehicle unit comprises an information handling device adapted to provide a position information item of the transit vehicle unit, the position information item comprising the actual time and date and/or a transit stop name, a time clock circuit adapted to provide the actual time and date to the information handling device, a vehicle control unit adapted to provide the transit stop name and/or preconfigured geographical location data of the transit stop to the information handling device, a door contact sensor adapted to provide a door open signal when a predetermined transit vehicle door is opened and a door close signal when the predetermined transit vehicle door is closed to the information handling device, and a geographical positioning system (GPS) unit adapted to provide geographical location information about a position of the transit vehicle to the information handling device. The information handling device is further adapted to provide a position information item, if the door contact sensor changes the door signal and/or if the geographical location information provided by the geographical positioning system (GPS) unit is substantially near to the preconfigured geographical location data of the transit stop and/or if the geographical location information provided by the geographical positioning system (GPS) unit does not change for a predetermined amount of time.

The transit vehicle unit transmits the position information item, if a transit stop has been identified. By means of the transit vehicle unit, the self-learning transit system, in particular the control center can be provided with precise location information, thereby enabling the control center to distribute transit stop forecasts with high accuracy. Advantageously, different options can be used to identify a transit stop location. One option is to use only a door contact sensor for determining the transit stop. Alternatively, only a geographical positioning system (GPS) unit can be used. In this option, the transit stop is identified, when the geographical location information does not change for a predetermined amount of time.

In a further alternative embodiment, both the contact sensor and the geographical positioning system (GPS) unit can be evaluated in order to detect a transit stop location. This option provides a fail safe determination of the transit stop.

An additional embodiment provides a method for a transit system central controller to learn and provide a continuously updated time table schedule forecast for a transit vehicle on a first transit route having a 1st to N transit stops. The method comprises a) providing the first transit route having the 1st to N transit stops; b) providing a 1st transit stop name for the 1st transit stop from a vehicle control unit to an information handling device; c) displaying on a transit vehicle display the 1st transit stop name; d) traveling by the transit vehicle to the 1st transit stop; e) arriving, by the transit vehicle, at the 1st transit stop and generating a 1st arrival signal and a 1st arrival time; f) providing by the information handling device the 1st transit stop name and the 1st arrival time to a wireless communication transceiver located on the transit vehicle; g) transmitting, by the wireless communication transceiver, the 1st transit stop name and the 1st arrival time to a central controller; h) storing in the central controller in a data base for the first route, the 1st transit stop name, the 1st arrival time and the day of the week; i) initiating departure, by the transit vehicle, from the 1st transit stop and generating a 1st departure signal and a 1st departure time; j) providing by the information handling device the 1st transit stop name and the 1st departure time to the wireless communication transceiver; k) transmitting, by the wireless communication transceiver, the 1st transit stop name and the 1st departure time to the central controller; l) storing in the data base for the first route, the 1st transit stop name, the first departure time and the day of the week; m) repeating steps (b) through (l) for each of the 2nd through N transit stops; n) repeating steps (a) through (m) at least once each day of the week for a predetermined number of weeks; o) calculating by the central controller a median time table for each of the 1st through N transit stops of the first transit route.

In another embodiment, the median time table is stored in a double compressed format.

In another embodiment, the 1st arrival signal is generated by a door open sensor associated with a predetermined door of the transportation vehicle.

In another embodiment, step (b) further comprises providing geographical location data of the 1st transit stop from the vehicle control unit to the information handling device and wherein generating the 1st arrival signal further comprises at least both opening a predetermined transit vehicle door and a Geographical Positioning System (like for example GPS from US, Galileo from Europe or Glonass from Russia) device indicating that the geographical location of the transit vehicle is the same as or proximate to the geographical location data of the 1st transit stop.

In another embodiment, (b) further comprises providing geographical location data of the 1st transit stop from the vehicle control unit to the information handling device and wherein the 1st arrival signal is further generated as a result of both a GPS device, attached to the transit vehicle, indicating that the geographical location of the transit vehicle is the same or proximate to the geographical location data of the 1st transit stop and the GPS location of the transit vehicle does not change for a predetermined amount of time.

In yet another embodiment of the invention, a system for creating and providing a transit stop forecast for a transit route is provided, wherein the transit route comprises a plurality of transit stops. The system comprises a first vehicle unit adapted for installation into a first transit vehicle. The vehicle unit comprises a vehicle position device adapted to estimate the vehicle unit's geographical location and provide geographical location data. Also, a vehicle control unit is adapted to store a list of the plurality of transit stops and transit stop data associated with each of the plurality of transit stops on the transit route. Additionally, a clock circuit adapted to provide date and time data is part of the system. A mobile data transceiver device adapted to wirelessly communicate over a mobile data network and an information handling device adapted to receive geographical location data from the vehicle position device, adapted to request and receive transit stop data for each transit stop from the vehicle control unit, and adapted to receive date and time data from the clock circuit are also included. The information handling device is further adapted to determine, using the geographical location data, whether the vehicle unit is stopped proximate to or is leaving from a geographical location that is of one of the plurality of transit stops. Additionally, the information handling device is adapted to determine that the vehicle unit is stopped proximate one of the plurality of transit stops, the information handling device is further adapted to create an arrival data package comprising a transit vehicle ID, a route ID, time and date data, and an indication that the transit vehicle stopped at one of the plurality of transit stops; and wherein the information handling device is further adapted to provide the arrival data package to the mobile data transceiver for wireless transmission over the mobile data network; and wherein, when the information handling device determines that the vehicle unit is leaving from the geographical location of one of the plurality of transit stops, the information handling device is further adapted to create a departure data package comprising the transit vehicle ID, the route ID, time and date data, and an indication that the transit vehicle is departing from one of the plurality of transit stops; and wherein the information handling device is further adapted to provide the departure data package to the mobile data transceiver for wireless transmission over the mobile network. The system further comprises a control center adapted to communicate over the mobile data network with the mobile transceiver, the control center comprising a database adapted to initially operate in a learning mode for a predetermined amount of time, wherein during learning mode the control center receives the arrival data packages and departure data packages from the vehicle unit and stores the received data in the data base.

In additional embodiments, the control center is further adapted to calculate an arrival medial time table of arrival times at each of the plurality of transit stops, a departure medial time table of departure times for each of the plurality of transit stops, and a travel time medial time table for the travel time from a first one of the plurality of transit stops to a second one of the plurality of transit stops.

In additional embodiments, the arrival medial time table, the departure medial time table and the travel time medial time table are stored in a double compressed format.

In additional embodiments, the control center is further adapted to operate in a normal or a $2^{nd}$ learning phase after the predetermined amount of time, wherein upon receiving a new arrival data package, the control center calculates and transmits an expected departure time over the mobile data network to the first vehicle unit for display on a first visual display connected to the first transit unit.

In additional embodiments, the control center is further adapted to operate in the normal or a $2^{nd}$ learning phase after the predetermined amount of time, wherein upon receiving a new departure data package, the control center calculates and transmits an expected arrival time at a next transit stop of the plurality of transit stops to the first vehicle unit for display on a first visual display connected to the first transit unit.

In additional embodiments, the expected arrival time at the next transit stop of the plurality of transit stops is further received by a second transit unit and displayed on a second visual display connected to the second transit unit.

In additional embodiments, the vehicle position device comprises a GPS device adapted to estimate the vehicle unit's geographical location and provide geographical location data.

In additional embodiments, the first vehicle unit further comprises a door open sensor adapted to provide a door open signal indicative that the transit vehicle is proximate to one of the plurality of transit stops to the information handling device.

In still yet another embodiment, a transit vehicle time table notification device is provided comprising an information handling device adapted to provide transit time table information to display to users of a transit system, the transit time table information to display comprising a selected transit stop name and an estimated time of arrival at the selected transit stop; a vehicle control unit adapted to store a list of N transit stop names comprising a first transit stop name to an Nth transit stop name and adapted to store transit stop name geographical location information for each of the N transit stop names, the vehicle control unit adapted to provide a selected transit stop name and geographical location information of the selected transit stop name from the list of N transit stop names to the information handling device; a geographical positioning system (GPS) unit adapted to provide geographical location information about a position of a transit vehicle in which the transit vehicle time table notification device is installed to the information handling device; a time clock circuit that provides a time signal to the information handling device; a door status sensor adapted to provide a door open signal when a predetermined transit vehicle door is opened and a door close signal when the predetermined transit vehicle door is closed to the information handling device; a telecommunication device adapted to accept and transmit a transmit data package from the information handling device to a central controller, the telecommunication device further being adapted to provide a received data package from the central controller to the information handling system; wherein when the door status sensor provides a door open signal at substantially the same time that the geographical location information indicates that the transit vehicle is substantially close to the geographical location information of the selected transit stop name, then the information handling system provides a first transmit data package to the telecommunication device for transmission by the telecommunication device to the central controller, the first transmit data package comprises the selected transit stop name and an indication of the time that the transit vehicle arrived at the selected transit stop name.

An embodiment wherein after the transmit data package is transmitted by the telecommunication device, the telecommunication device is adapted to receive a first data package from the central controller, the received first data package comprises an updated time estimation of when the transit vehicle will depart from the selected transit stop name.

An embodiment wherein after the transmit data package is transmitted by the telecommunication device and the door status sensor provides a door closed signal, the information handling system provides a second transmit data package to the telecommunication device for transmission by the telecommunication device to the central controller, the second transmit data package comprise the selected stop name and an indication of the time that the transit vehicle is departing the selected transit stop name.

An embodiment wherein after the second transmit package is transmitted by the telecommunication device, the telecommunication device is adapted to receive a second data package from the central controller, the received second data package comprises an updated time estimation of when the transit vehicle will arrival at a next selected transit stop name to be provided by the information handling device for display to users of the transit system.

An embodiment wherein the central controller comprises a data base and a microprocessor adapted to organize and store indications of the times that the transit vehicle arrived at each of the N transit stop names in the data base; the microprocessor further adapted to calculate the updated time estimation of when the transit vehicle will depart from the selected transit stop name.

An embodiment wherein the central controller comprises a data base and microprocessor adapted to organize and store indications of the times that the transit vehicle departed from each of the N transit stop names in the data base, the microprocessor further adapted to calculate the updated time estimation of when the transit vehicle will arrival at a next selected transit stop name based on the stored indications of the times that the transit vehicle departed from the selected transit stop name.

An embodiment wherein the time of arrival and time of departure data for each of the N transit stop names are further organized by at least the day of the week and the time of day.

BRIEF DESCRIPTION OF THE DRAWINGS

In the drawings, like elements are depicted by like reference numeral. The drawings are briefly described as follows.

FIG. 3 provides an exemplary application flow indicating the operation and communication of data between the various elements of an exemplary embodiment.

DETAILED DESCRIPTION

Figure 1:
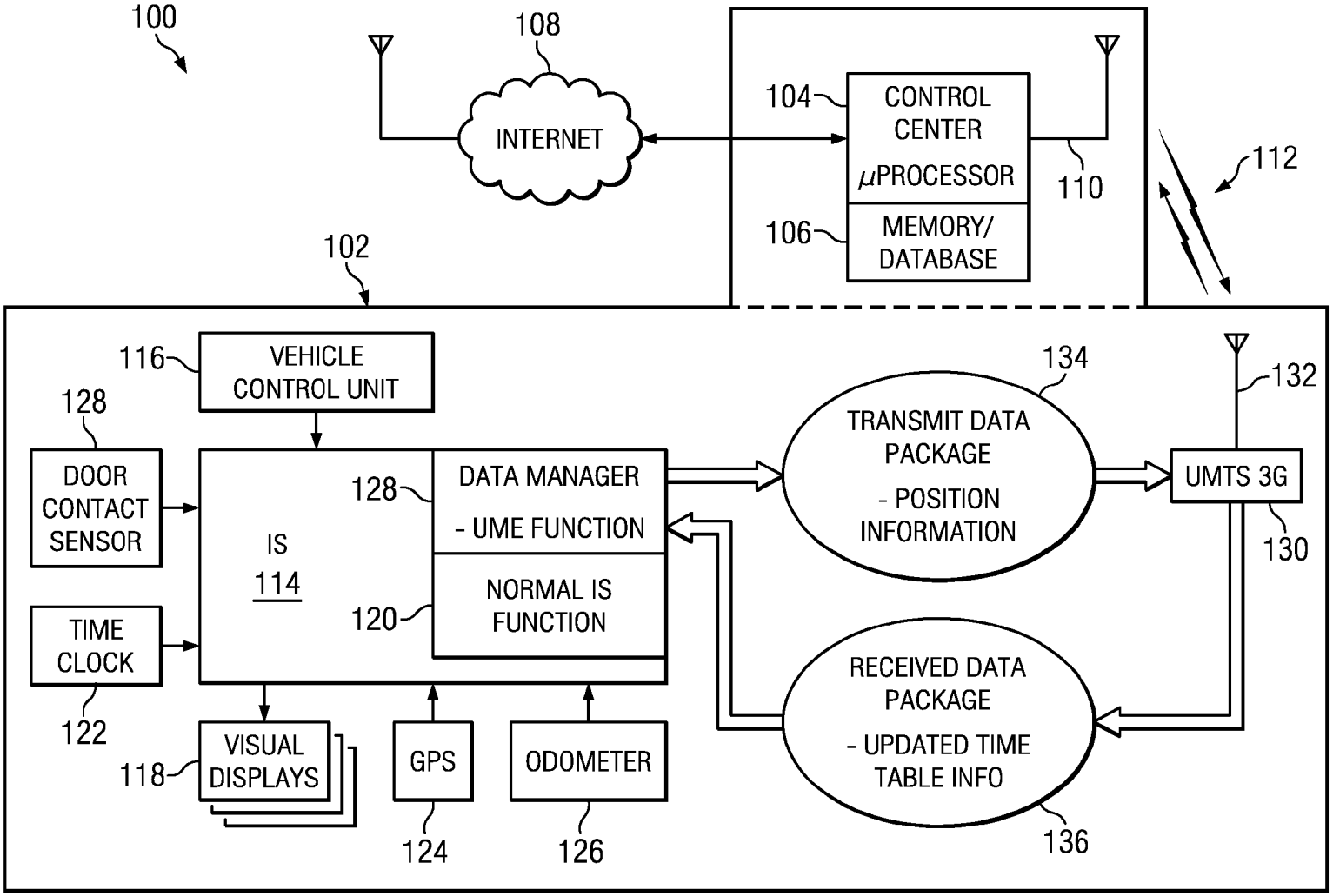
FIG. 1 provides an exemplary embodiment of a transit system arrival and departure time calculation and display system.

Referring now to the drawings, wherein like reference numbers are used herein to designate like elements throughout, the various views and embodiments of exemplary transportation system arrival and departure time calculation and display systems are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of various exemplary embodiments.

Some embodiments of the invention provide an arrival and departure schedule creation and schedule maintenance system and method for use on and with a transportation vehicle that is assigned a specific route within a transportation system. A transportation vehicle may be a bus, trolley, train, subway or other transportation vehicle that makes a plurality of stops on its assigned route. Referring to FIG. 1, an exemplary schedule creation and maintenance system 100 may have two major components. One of the major components being the transportation vehicle unit 102, which is installed on the transportation vehicle. The transportation vehicle unit 102 may have various components and modules associated with it. The second device of an exemplary schedule creation and maintenance system is a control center 104, which is normally located in a stationary location that may be close to or far away from the actual transportation route that the transportation vehicle (not specifically shown) with the transportation vehicle unit 102 installed therein is operating. The control center 104 may be a server or other microprocessor based computer system that also includes a memory device for storing data and software 106. The control center may also be able to communicate with the Internet 108 and wirelessly by an antenna 110. The control center 104 may communicate with a plurality of schedule creation and maintenance systems installed in various transportation vehicles throughout a public transportation system of one or more cities. In some embodiments, the control center may not be located in or near the city or transportation route that the plurality of transportation vehicles are operating in. The control center 104 may also communicate via the Internet 108 via an application or software service and then wirelessly with a transportation vehicle 102.

The wireless network 112 is used by the control center 104 and the transportation vehicle unit 102 to communicate there between by substantially any standardized telecom or messaging communication system.

The transportation vehicle unit 102 has an information handling device or infotainment (IS) 114 that communicates via electrical connections to various other devices and modules on the transportation vehicle. For example, the IS 114 may communicate with various visual display devices 118 to provide visual display information to be displayed on the visual display devices 118 for passengers on the interior or patrons who are on the exterior of the vehicle to view. Such information may include the transit vehicle's route number, the name of the next station or destination, the present time and date, and the amount of time until the transportation vehicle reaches the next station or leaves the present station at which it is stopped.

In order for the IS 114 to provide such information to the visual displays 118, the vehicle control unit 116 contains preprogrammed information that is stored in its memory. Such programmed information includes the name of all the stations or stops on the route and an indication of the order of the stops so the next destination can be determined. This information is normally preprogrammed into the vehicle control unit 116 and is provided on-demand by the IS 114.

The IS 114 may be a bus or other transportation vehicle infotainment system that may provide various well-known infotainment system functions. For example, the infotainment system 114 may comprise a central processing unit (not specifically shown) that has software loaded into a memory of the infotainment system adapted to provide instructions to the CPU so that it performs a variety of infotainment system functions (IS functions). The IS functions of the IS system 114 include normal IS functions 120 performed by hardware and software such that the software provides instructions to make the hardware of the IS system 114 provide data to the visual displays 118 such that the visual displays display the next stop, the final destination of the route, the present time, the time to the next destination, the route number that a transportation vehicle is travelling on and/or advertisement information. A time clock circuit or module 122 is part of the infotainment system 114 or may be electrically separated from the infotainment system 114. The time clock provides time of day and calendar date information to the IS 114 for use in the normal IS functions 120 and other IS functions. The time clock may be synchronized with other transit system time clocks using the network time protocol (ntp) standard.

Referring back to the vehicle control unit 116, the vehicle control unit may also contain additional information associated with the stations or stops for the particular routes. For example, for each stop there may be additional information indicating its geographical location. Such geographical location information may include route distance between each transit stop or latitude and longitude data associated with the GPS location of each destination on the route. The IS 114, in some embodiments, may be connected to a global positioning system device (GPS device) 124 as well as an electronic output of the transportation vehicle's odometer 126. By using the geographical location data stored in the vehicle control unit 116 in association with data from the GPS 124 and/or the odometer 126, the IS 114 can determine where the transportation vehicle is located relative to each destination or bus stop.

A door contact sensor 128 is associated with one or more of the transportation vehicles' doors. The contact sensor 128 provides an indication to the IS 114 at to whether a transportation vehicle door is open or closed.

Still referring to FIG. 1, the IS 114 further includes the data manager block 128, which acts as an interface between the IS 114 and a universal mobile telephone system (UMTS) block 130. In some embodiments, the UMTS block 130 is adapted to communicate wirelessly via a 3G wireless network 112 with the control center 104. The UMTS block 130 is a transceiver that can both send and receive data packages between the transportation vehicle unit 102 and the control center 104.

In exemplary embodiments of the invention, the IS 114 provides the data manager block 128 with actual position information. The position information may include the route number, a transit stop location name, and an indication of whether the transit vehicle is arriving at the stop or departing from the stop, and the date and time. The data manager 128 forms the position information into a transmit data package 134, which is provided to the UMTS block 130. The UMTS block 130 then transmits the transmit data package from the antenna 132, through the wireless network 112. The control center 104 receives the transmit data package 134 from the wireless network 112 and initially uses such information to create an initial time table for the designated transportation route (to be explained below). Upon calculating and/or updating the departure and arrival times for the designated transportation route, the control center 104 transmits an updated time table data package via antenna 110 and through the wireless network 112. The updated time table data package is received by the UMTS block 130 and provided to the data manager 128 as a received data package 136 that comprises updated time table information.

In some embodiments, the UMTS block 130 may communicate wirelessly with the Internet 108 wherein the transmit data packages 134 and received data packages 136 are communicated between the UMTS block 130 and the Internet 108 via a wireless communication system. In this situation, Internet 108 is used as a conduit for communicating between the control center 104 and the UMTS 130.

Various embodiments of the present invention do not require an initial transportation schedule to be manually entered or programmed into either the control center 104 or the transportation vehicle unit 102 prior to its initial use. Instead, embodiments of the invention perform a self-learning algorithm comprising a learning phase 1 and a learning phase 2. The overall outcome of the learning phase 1 and 2 is the creation of a transportation route time table that provides a transportation vehicle user a more accurate indication of a transportation vehicle's arrival and departure time on the day of travel that is based on historic data collection of actual arrival and departure times for each stop on a transportation route.

Figure 2:
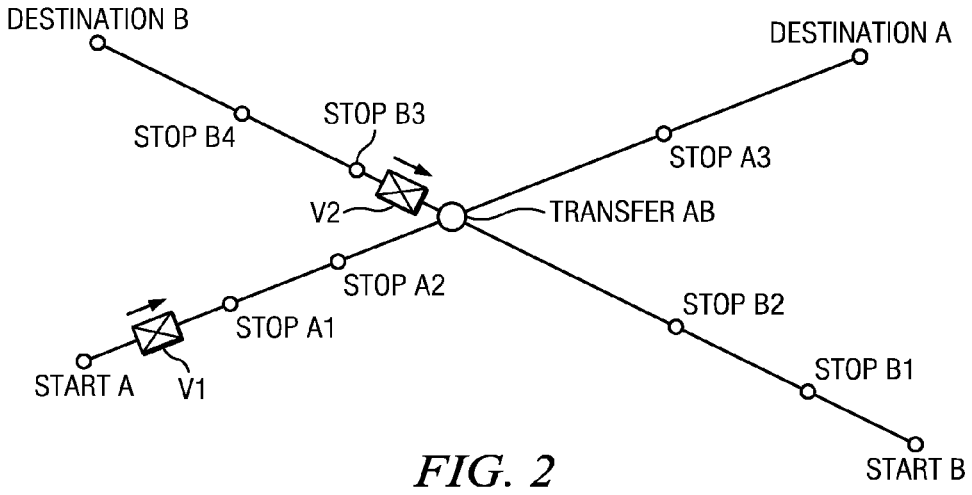
FIG. 2 provides a drawing of a transit system having two transit lines that intersect at a transfer location.

Referring to FIGS. 1 and 2, FIG. 2 depicts two transportation routes being transportation route A 200 and transportation route B 202. Transportation route A has a starting point A, a first stop A1, second stop A2, a transfer location AB, a stop A3 and a destination A. Similarly, transportation route B 202 has a starting point on the route, a stop B1, a stop B2, the transfer location AB, stop B3, stop B4, and destination B. In an exemplary embodiment, during the learning phase 1, a transportation vehicle V1 travels on the transportation route A 200 from start A to destination A and then back again repetitively during the course of each weekday. When the transportation vehicle V1 stops at, for example, stop A1 and the door to the transportation vehicle opens, the contact sensor 128 provides a door open indication to the IS 114. The IS 114 then determines, based on the odometer 126 data and/or the GPS data 124, whether the bus has arrived at a next designated stop if the information about the next designated stop from the vehicle control unit 116 is substantially similar to the data information provided by the GPS device 124 and/or the odometer 126. If the next stop location data provided by the vehicle control unit 116 is substantially similar to the information provided by the GPS 124 and/or the odometer 126, then the IS 114 provides the data manager block 128 the time and date information, route number information, the stop name information (in this case, stop A1), and an indication that the transit vehicle V1 is arriving at stop A1. The data manager 128 then sends a transmit data package 134 containing the updated position information of the vehicle V1 to the UMTS block 130. The UMTS block 130 then transmits via the wireless network 112 the position information to the control center where it is stored. This process is repeated again for stop A1 when the door contact sensor 128 indicates that a specific door of the transit vehicle has been closed thereby indicating that the transit vehicle is departing from stop A1.

When departing from a stop, the IS 114 provides the route number, the name of the stop, the time and date, and an indication that the transit vehicle is departing from the stop. In some embodiments, wherein the GPS system is part of the transportation vehicle unit 102, the GPS position may also be provided in the transmit data package 134. As the transportation vehicle V1 arrives and departs from each stop (stop A2, transfer location AB, stop A3 and destination A) a transmit data package 134 is provided to the control center when the door contact sensor indicates that the door is opened and again when the door contact sensor indicates that the transit vehicle's door is closed. Thus, arrival and departure time for each transit stop is sent via the UMTS block 130 and the wireless network 112 to the control center 104 for storage. This learning phase 1 may be performed for about two weeks in order to collect, for example, 10 real-time values for every arrival and departure time of each transit stop location on the particular route. After two weeks time, there should be enough collected data within the control center's memory 106 to calculate a medial time table for the specific route. This medial time table may not be perfectly exact, but can provide a good average indication of the arrival and departure times of a transit vehicle V1 for each transit stop on the route.

In additional embodiments, the control center 104 may create a database in the memory 106 wherein working days (Monday-Friday) are all stored in a same database while non-working days (weekends and/or holidays) are stored in a separate database. By separating weekday transportation arrival and departure time from weekend and/or holiday transportation arrival and departure time, the resulting route time schedules take into consideration the different traffic congestion patterns that a transit vehicle is subjected to during weekdays and weekends or holidays. In some embodiments, data can be stored for different seasons of the year, different weather conditions, different transit vehicles, different transit vehicle drivers and perhaps road construction obstacles or detour time periods.

The control center 104, which may comprise a server, calculates a medial time table using the transmit data packages 134 received from one or more transit vehicles V1 that are operating on a same route. The data is stored in the control center's database 106 in one of various types of formats. In one format, the database may count the number of times that the transit vehicle arrived at the particular transit vehicle stop at 1:05 p.m. It would also store how many times the transit vehicle arrived at the same stop at 1:06 p.m., 1:07 p.m., 1:08 p.m., etc. The average of the arrival times may be calculated as the medial time of arrival for the particular stop. This sort of database may be referred to as a single compressed database. In other embodiments, a double compressed format for storing arrival and departure times for each stop may be used. One example of a double compressed format is to store the median time that a transit vehicle arrives at a particular stop while also storing the number of times the transit vehicle arrived more than a predetermined number of minutes (for example, 5, 6, 10, 12 minutes) before and after the median time. By using a double compressed format, the amount of memory space 106 required to store the medial time table for each transit route will not grow larger than a predetermined size even if the system is operated for 10 or more years while recording every arrival and departure time at every stop. Furthermore, use of a double compressed format aids in increasing the accuracy of the resulting medial time table for each route.

Learning phase 2 starts immediately after learning phase 1 ends. Learning phase 2 is essentially the continuous collection of arrival and departure data for each stop on a transportation route so as to continuously collect data and improve the accuracy of the route schedule over time. During learning phase 2, the control center 104, upon receiving a departure time for a first stop, for example, stop A1, will provide updated time table information via the wireless communication 112 or the Internet communication system 108 to the UMTS 130. UMTS 130 will then provide the received data package containing updated time table information to the data manager 128 of the IS 114 on the transit vehicle. The IS 114 may then display on the displays 118 an updated estimated time for arrival at the next stop, for example, stop A2. This updated information can be very useful for a passenger who is interested in transferring from transit vehicle V1 on transportation route A 200 to transit vehicle V2 at the transfer location AB. Since over time the database 106 in the control center 104 will contain an accurate estimation of the amount of time that it will take for a transit vehicle V1 that is departing from stop A1 at a specific time to arrive at the transfer location AB, the transit vehicle user will feel more comfortable as to whether or not they will arrive before or after the departure of transit vehicle V2 from the transfer location AB. Furthermore, if the transit vehicle is running behind schedule, updated arrival and departure times are provided that may account for the weather, the load of passengers, construction along the route or other conditions for which arrival and departure times have been collected.

In additional embodiments, the control center 104 also provides updated time table information (via data packages) to transit vehicles operating on other routes that are also arriving at a shared transfer location. The IS 114 will display such transfer information on the visual displays within or about the various transit vehicles.

As the database 106 for each particular route matures, the database can be configured to distinguish between departure and arrival times for rainy Mondays in January versus departure and arrival times for sunny Mondays in July. Thus, the estimated time to travel between two transit vehicle stops can be calculated more accurately for a variety of transit condition variables including the time of year, time of day, day of week, the weather condition, construction conditions, the particular transit vehicle and/or the particular vehicle operator.

Using this two phase approach, exemplary embodiments provide a very accurate means for transit vehicle schedule generation without any initial or subsequent data entry required by a person. In additional embodiments of the invention, the control center 104 can store and/or keep track of the arrival and departure time for every stop on every route in a transit vehicle system. With storage of arrival and departure time data for every stop of a transit route, the typical standby time of a specific stop can also be calculated. Furthermore, a typical driving time from any particular first stop to a next stop or any other stop can also be calculated for various transit vehicle route conditions. Using a double compressed format to store arrival and departure times for each stop and each transit route condition guarantees that the memory size and database size will not grow larger than a predetermined size.

In other embodiments, a method of creating a route schedule may include entering, by a person, an initial time table into the memory or database 106 of the control center 104. In this embodiment, the self-learning algorithm for phase 1 and phase 2 is sped up by skipping phase 1 and immediately starting with phase 2. As the phase 2 process gathers arrival and departure times and data for each stop in a route, the control center 104 calculates a more accurate medial time table, but may use a weighting factor for the initial entered schedule data for a predetermined amount of time until enough actual position information from transmit data packages 134 are stored in the memory database 106.

In some embodiments, where there is no door contact sensor 128 connected to the IS 114, then the IS 114 may still determine the time when a transit vehicle arrives and departs from a transit stop by using the GPS 124. In this embodiment, the IS reads the actual position of the transit vehicle using the GPS at predetermined time increments. If the GPS location is substantially near or equal to the GPS location provided by the vehicle control unit for the particular stop and the GPS location does not change position for a predetermined number of seconds, then the IS 114 may determine that the transit vehicle has arrived at the next stop. (This will not happen at a traffic control signal). When the GPS indicates that the transit vehicle has started to move again, the IS 114 can determine the time of departure from the same stop and provide the information to the control center.

In some embodiments, where there is no door contact sensor 128 connected to the IS 114, then the IS 114 may still determine the time when a transit vehicle arrives and departs from a transit stop by using the GPS 124. In this embodiment, the IS reads the actual position of the transit vehicle using the GPS at predetermined time increments. If the GPS location does not change position for a predetermined number of seconds, then the IS 114 may determine that the transit vehicle has arrived at the next stop. (This could also happen at a traffic control signal. But the presumption is that the vehicle will stop more often at stops then at traffic control signals. With this presumption (and in some embodiments, with stored data for the GPS locations of the transit stops) the algorithm can distinguish between stops and traffic control signals). When the GPS indicates that the transit vehicle has started to move again, the IS 114 can determine the time of departure from the same stop and provide the information to the control center.

All the transportation vehicles in the transportation system and the control center 104 should be operating using the same time base. In exemplary embodiments, a same time base for all of the vehicles and the control center is realized using the network time protocol (ntp), which is an established software standard. The time clock 122 may be updated by the IS 114 using the ntp standard. Furthermore, the control center 104, which also has a time clock function therein is also updated using the ntp standard.

An exemplary protocol may be used for the position information data in the transmit data packages 134. In some embodiments, a UME function may operate within the data manager 128. The UME function may establish data packages according to Java, SAP or other data protocols. Regardless of the protocol used, the transmit data package, which provides transit vehicle position information may comprise the following content:

1. The serial number of the transmitting infotainment system;
2. The line or route number in which the transit vehicle is operating;
3. The name of the stop that the transportation vehicle is arriving at or departing from (generally, this is the stop name shown on the visual displays 118 by the IS 114);
4. The actual time and date (as synchronized with the control center server 104;
5. The GPS position of the transportation vehicle (only in embodiments that include a GPS system);
6. An arrival at the stop indication (Boolean: true or false); and
7. A departure from the stop indication (Boolean: true or false).

Additional embodiments may include operating an exemplary transportation vehicle unit 102 that comprises both a GPS 124 and a door contact sensor 128 connected to an IS 114. In this embodiment, a transmit data package 134 may be sent from the transportation vehicle unit 102 about every minute or other predetermined periodic time frame. If the door of the transit vehicle is not opened then the transmit data package 134 has the arrival indication set to false and the departure indication set to false with the name of the stop indication being set to the next stop that the transportation vehicle is driving to. If the door contact sensor 128 indicates that the transit vehicle door is open (i.e., the contact sensor senses that the transit door has changed from a closed position to an open position), then the transportation vehicle unit 102 will send a transmit data package 134 containing position information wherein the arrival indication is set to true, the departure indication is set to false and the name of the stop remains the same stop name that was set when the door contact sensor indicated that the transit vehicle was not open (i.e., the name of the stop is halted rather than indicating a new next stop). Additionally, if the signal from the door contact sensor 128 indicates that the door has closed (i.e., the signal changes from an open indication to a closed indication), then the transit vehicle unit 102 immediately sends a transmit data package containing position information comprising arrival indication set to false and the departure indication set to true with the name of the stop being unchanged (i.e., the name of the stop does not change to the next new stop until after this transmit data package is sent to the control center 104). Thereby indicating a departure from the stop.

In an embodiment wherein an exemplary transportation vehicle unit 102 comprises a GPS device, but does not have a door contact sensor signal, a transmit data package with position information may be sent about every 10 seconds or at another relatively short, less than 30 second predetermined intervals, from the transit vehicle unit 102 to the control center 104. In this embodiment, the GPS position is checked very often to see if it does not change for a predetermined period of time. If the position does not change for a predetermined period of time, then the bus is at a stop, a traffic sign, in a traffic jam, or broken down. If GPS data is stored along with the stop names in the vehicle control unit 116, then the GPS data can be compared with the stored GPS data to determine if the transit vehicle is substantially close to the next bus stop. If the transit vehicle is substantially close to the next indicated bus stop, then an arrival indication can be set to true with a departure indication set to false along with the name of the stop that the transportation vehicle arrived at. When the GPS device 124 indicates that the bus has begun to move, a transmit data package with position information will be immediately sent to the control center 104 indicating that the arrival indication is false and the departure indication is true.

In an exemplary embodiment wherein the transportation vehicle unit 102 does not include a GPS device 124 but does include a door contact sensor 128, then when the door contact sensor 128 changes from a closed to an open indication, the IS 114 immediately sends a transmit data package with position information via the UMTS block 130 to the control center 104 that includes the arrival indication set as being true and a departure indication being set as false along with the name of the stop that was the previous next stop (i.e., the stop name is halted for a moment). Additionally, when the door contact sensor 128 changes from an open indication to a closed indication, then the transportation vehicle unit 102 immediately sends a transmit data package 134 to the control center 104 comprising the arrival indication being set as and the departure indication being set to true along with the name of the stop that the transit vehicle is departing from.

In alternative embodiments, wherein there is no GPS 124 connected to the infotainment system 114, the odometer 126 may be used to measure the average distance between stops in order to help indicate that the transportation vehicle has arrived at, departed from or is stopped at a particular transit vehicle stop.

Referring now to FIG. 3, an application flow of an exemplary method is provided. At time T01, the engine of the transit vehicle for example, a bus or a tram, is started by a transit vehicle operator. At time T02, the vehicle control unit 116 and the infotainment system are booting. Meanwhile, the control center 104 is continuously operational. At time T03, the vehicle control unit (VCU) provides the route destination name to the IS 114 for displaying on the digital displays of the transportation vehicle at time T04. At time T05, the VCU 116 provides the next stop name to the IS 114 for displaying on the digital displays 118 at time T06. The transit vehicle begins its route toward the next stop and at time T07, the transit vehicle has stopped or arrived at the next stop and a predetermined door of the transit vehicle is opened. As a result of the predetermined door opening, the door contact sensor 128 provides an indication that a predetermined door of the transit vehicle has opened to the IS 114. At T8, the IS 114, using the data manager 128, prepares a transmit data package 134 comprising position information, which is to be sent via wireless communication to the control center for storage into the memory or database 106 of the control center 104. If the exemplary embodiment is in learning phase 1, then the control center 104 will store the arrival position information for the particular route and transit stop in its database 106 for use when enough information is gathered. In some embodiments, in the learning phase 1, the initial arrival information is stored and also used as data for an actual initial time table.

If the system is in learning phase 2, then at time T09, the control center calculates and updates the actual time tables for the particular route and vehicle. At time T10, the control center transmits the updated time table information to the transportation vehicle unit 102 and its IS 114. The updated time table contains the calculated expected departure time for the transit vehicle from the present stop, which at time T11, the IS 114 will provide to the visual displays 118 so that users of the transit vehicle can see the departure time of the vehicle. At time T12, the door of the transit vehicle is closed and the door contact sensor 128 indicates that the door has changed from an open position to closed position to the IS 114. In response to the change of the door contact sensor indication, the IS 114 prepares and sends a transmit data package 134 to the control center via the wireless network 112 comprising an indication that the transportation vehicle is departing from its present stop along with the time of the departure. The control center stores this information and the memory database 106 and proceeds to calculate, at time T14 and update the time tables for the route. At time T15, the control center provides the updated time table via the wireless communication network, to the IS 114. The transmission includes the expected time that the transit vehicle will arrive at the new next stop. At T16, the VCU 116 provides a new next stop name as the next stop to the IS 114, which it displays as the next stop on the visual displays 118 for the transit vehicle riders to view. At time T18, the IS 114 also shows the updated expected arrival time for the next stop and, if the next stop is a transfer station, transfer information associated with other transportation vehicles that will be arriving or have already arrived at the transfer station.

Figure 4:
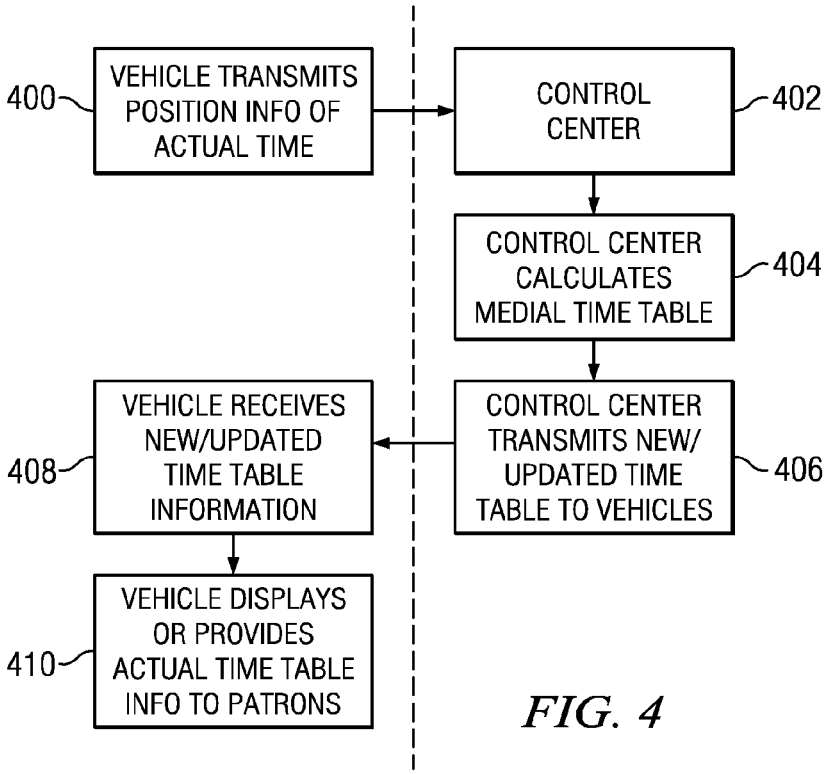
FIG. 4 provides a flowchart of an exemplary method of providing a real-time, updated transit schedule in accordance with an embodiment of the invention.

Referring now to FIG. 4, a flow chart of an exemplary method for providing a real-time updated transit schedule in accordance with an embodiment of the invention is provided. Here at step 400, a transit vehicle that has an exemplary vehicle unit 102 installed is operating on a particular transit route and is either arriving at or departing from a transit stop on the transit route. The transportation vehicle transmits position information that may include the serial number or identification indicia of the transportation vehicle unit 102 the line or route number that the transportation vehicle is operating on, the name of the stop that the transportation vehicle is either arriving at or departing from, the actual time and date of the arrival or departure, the GPS position of the transit vehicle (if the exemplary transportation vehicle unit 102 is so equipped) and an indicia indicating whether the transportation vehicle is arriving at or departing from the indicated stop. At step 402, the control center receives the transit data package that comprises the position information of the particular transit vehicle on the particular transit route and stores the data in an appropriate database in accordance with the data format of the database. The control center in step 404 uses the newly received position data information from the transit data package to either help initially calculate a medial time table or to update and recalculate an existing medial time table depending on whether the arrival and departure schedule creation and maintenance system 100 is operating for this route in a learning phase 1 or learning phase 2 mode. At step 406, the control center transmits either a new or an updated time table for the particular transit vehicle on its route to the plurality of transit vehicles operating on transit routes that are either the same as or intercept with the predetermined transit route at a transfer location. At step 408, the predetermined transit vehicle's transportation vehicle unit 102 receives the new more-updated or actual time time table from the control center and displays or provides the actual time time table, or parts thereof, to the transit vehicle patrons so that the transit vehicle patrons have a more accurate understanding of the transit vehicle's schedule in near real-time while they are on route to their destination.

In some embodiments, the control center may further provide updated information to patrons via the Internet 108, so as to enable them to better organize and use their time. In particular, a transit vehicle patron may view updated near real-time transit vehicle schedule information and find that the particular transit vehicle that they need to ride is operating ten or fifteen minutes late. Such information can be provided to any device adapted to receive internet information including mobile devices, information pads, computer devices, kiosks and other display units.

The foregoing discussion of the various embodiments and methods of the invention has been presented for purposes of illustration and description. Further, the description is not intended to limit the invention to the form disclosed herein. Consequently, variation and modification commensurate with the above teachings, within the skill and knowledge of the relevant art, are within the scope of the present invention. The embodiment described hereinabove is further intended to explain the various exemplary modes presently known for practicing the invention and to enable others skilled in the art to utilize the invention as such, or in other embodiments, and with the various modifications required by their particular application or uses of the invention. It is intended that the appended claims be construed to include alternate embodiments to the extent permitted.

What is claimed is:

1. A method for providing a transit stop forecast in a self-learning transit system comprising a control center and a transit vehicle unit adapted to be installed into a transit vehicle traveling on a transit route, wherein the transit route comprises a plurality of transit stops, the method comprising:

a) providing a position information item of the transit vehicle unit to the control center, wherein the position information item is provided when a door sensor on the transit vehicle senses a first door status of a door changing from a closed status to an opened status, and wherein the position information item is also provided when the door sensor on the transit vehicle senses a second door status the door changing from the opened status to the closed status;

b) storing the position information item in a memory device of the control center;

c) repeating steps (a) and (b) until a predetermined number of position information items have been stored;

d) calculating by the control center a medial time table for each of the transit stops based on the stored position information items and storing the medial time table in the memory device; and e) providing the medial time table to the transit vehicle unit as the transit stop forecast.

2. The method of claim 1, further comprising:

repeating steps (a), (b), (d) and (e) after the predetermined number of position information items have been stored.

3. The method of claim 1, wherein the position information item comprises the actual time and date and/or a transit stop name.

4. The method of claim 1, wherein the position information item is provided to the control center as an arrival indication when the door sensor senses the first door status and the transit vehicle is determined to be positioned proximate to one of a plurality of transit stops, and wherein the position item is provided to the control center as a departure indication when the door sensor senses the second door status and the transit vehicle is determined to be positioned proximate to one of the plurality of transit stops.

5. The method of claim 1, wherein the position information item is further provided to the control center on predetermined time intervals, when the transit vehicle is traveling along the transit route.

6. The method of claim 1, wherein the position information item and the medial time table are stored in the memory device of the control center in a double compressed format.

7. The method of claim 1, wherein the control center creates a plurality of databases in the memory device, wherein each position information item is stored in one of the databases dependent on preconfigured conditions, wherein the medial time table is calculated for each database separately and wherein the medial time table provided to the transit vehicle unit is selected dependent on the preconfigured conditions.

8. The method of claim 7, wherein the preconfigured conditions comprise a time of day, a day of the week, a date, a holiday flag, a season of the year, an identification of the transit vehicle, an identification of a driver of the transit vehicle, weather conditions and/or road construction data.

9. A self-learning transit system for providing a transit stop forecast for a transit vehicle traveling on a transit route, wherein the transit route comprises a plurality of transit stops, the system comprising:

a transit vehicle unit configured to be installed into the transit vehicle and to provide position information items of the transit vehicle unit when the transit vehicle unit determines, based on an open/close signal received from a door sensor on the transit vehicle, that a door status of a door changed from a closed status to an opened status and when the transit vehicle unit determines, based on the open/close signal received from the door sensor on the transit vehicle, that the door status of the door changed from the opened status to the closed status;

a control center connected to the transit vehicle unit via a wireless communication network and adapted to receive and store the position information items in a memory device comprised by the control center;

wherein the control center, as soon as a predetermined number of position information items have been stored, is further configured to calculate a medial time table for each of the transit stops based on the stored position information items, to store the medial time table in the memory device and to provide the medial time table to the transit vehicle unit as the transit stop forecast.

10. The transit system of claim 9, wherein the transit vehicle unit is further adapted to provide position information items that comprise the actual time and date and/or a transit stop name.

11. The transit system of claim 9, wherein the transit vehicle unit comprises the door sensor, an odometer and/or a geographical positioning system (GPS) to provide data to enable the transit vehicle unit to determine that the transit vehicle is arriving or departing from one of the transit stops or to provide information to enable the transit vehicle unit to determine that the transit vehicle is between transit stops.

12. The transit system of claim 9, wherein the transit system further comprises additional transit vehicle units configured for installation into additional transit vehicles, and wherein the control center is further configured to provide the medial time table to the additional transit vehicle units operating on the transit route or on different transit routes that intercept with the transit route at a transfer location.

13. The transit system of claim 9, wherein the control center is connected to the Internet and further adapted to provide the medial time table to devices connected thereto.

14. The transit system according to claim 9, wherein the transit vehicle unit further comprises:

an information handling device configured to provide a position information item associated with the transit vehicle unit, the position information item comprising the actual time and date and/or a transit stop name;

a time clock circuit configured to provide the actual time and date to the information handling device;

a vehicle control unit configured to provide the transit stop name and/or preconfigured geographical location data of the transit stop to the information handling device;

the door sensor configured to provide the open/close signal indicative of whether the door status has changed from the closed status to the opened status and when the door status has changed from the opened status to the closed status, and further when the door status has not changed from a closed status to an opened status to the information handling device;

a geographical positioning system (GPS) unit configured to provide geographical location information about a position of the transit vehicle to the information handling device;

wherein the information handling device is further configured to provide the position information item, when open/close signal indicates that the door status has changed from the closed status to the opened status or from the opened status to the closed status and the information handling device determines, based on geographical location information provided by the geographical positioning system (GPS) unit that the transit vehicle unit is substantially near to the preconfigured geographical location data of the transit stop.

15. A system for creating and providing a transit stop forecast for a transit route, wherein the transit route comprises a plurality of transit stops, the system comprising:

a first vehicle unit adapted for installation into a first transit vehicle, the vehicle unit comprising:

a vehicle position device configured to estimate the vehicle unit's geographical location and provide geographical location data;

a door sensor configured to provide a open/close signal indicative of whether a door status for a door on the transit vehicle changes from a closed status to an opened status or from the opened status to the closed status;

a vehicle control unit configured to store a list of the plurality of transit stops and transit stop data associated with each of the plurality of transit stops on the transit route;

a clock circuit configured to provide date and time data;

a mobile data transceiver device configured to wirelessly communicate over a mobile data network;

an information handling device configured to receive geographical location data from the vehicle position device, configured to receive the open/close signal from the door sensor, configured to request and receive transit stop data for each transit stop from the vehicle control unit, and configured to receive date and time data from the clock circuit; the information handling device further configured to determine, using the geographical location data and the open/close signal, whether the vehicle unit is arriving and proximate to or is leaving from a geographical location of one of the plurality of transit stops;

wherein, when the information handling device determines that the vehicle unit is arriving proximate to one of the plurality of transit stops, the information handling device is further adapted to create an arrival data package comprising a transit vehicle ID, a route ID, time and date data, and an indication that the transit vehicle arrived at one of the plurality of transit stops; and wherein the information handling device is further configured to provide the arrival data package to the mobile data transceiver for wireless transmission over the mobile data network; and wherein, when the information handling device determines that the vehicle unit is leaving from the geographical location of one of the plurality of transit stops, the information handling device is further adapted to create a departure data package comprising the transit vehicle ID, the route ID, time and date data, and an indication that the transit vehicle is departing from one of the plurality of transit stops; and wherein the information handling device is further configured to provide the departure data package to the mobile data transceiver for wireless transmission over the mobile network; and a control center configured to communicate over the mobile data network with the mobile transceiver, the control center comprising a database configured to initially operate in a learning mode for a predetermined amount of time, wherein during learning mode the control center receives the arrival data packages and departure data packages from the vehicle unit and stores the received data in the data base.

16. The system of claim 15, wherein the control center is further configured to calculate an arrival medial time table of arrival times at each of the plurality of transit stops, a departure medial time table of departure times for each of the plurality of transit stops, and a travel time medial time table for the travel time from a first one of the plurality of transit stops to a second one of the plurality of transit stops.

17. The system of claim 16, wherein the arrival medial time table, the departure medial time table and the travel time medial time table are stored in a double compressed format.

18. The system of claim of 15, wherein the control center is further configured to operate in a normal mode after the predetermined amount of time, wherein upon receiving a new arrival data package, the control center calculates and transmits an expected departure time over the mobile data network to the first vehicle unit for display on a first visual display connected to the first transit unit.

19. The system of claim 15, wherein the control center is further configured adapted to operate in normal mode after the predetermined amount of time, wherein upon receiving a new departure data package, the control center calculates and transmits an expected arrival time at a next transit stop of the plurality of transit stops to the first vehicle unit for display on a first visual display connected to the first transit unit.

20. The system of claim 19, wherein the expected arrival time at the next transit stop of the plurality of transit stops is further received by a second transit unit and displayed on a second visual display connected to the second transit unit.

21. The system of claim 15, wherein the vehicle position device comprises a GPS device configured to estimate the vehicle unit's geographical location and provide geographical location data.

22. A transit vehicle time table notification device comprising:

an information handling device configured to provide transit time table information to display to users of a transit system, the transit time table information to display comprising a selected transit stop name and an estimated time of arrival at the selected transit stop;

a vehicle control unit configured to store a list of N transit stop names comprising a first transit stop name to an Nth transit stop name and configured to store transit stop name geographical location information for each of the N transit stop names, the vehicle control unit configured to provide a selected transit stop name and geographical location information of the selected transit stop name from the list of N transit stop names to the information handling device;

a geographical positioning system (GPS) unit configured to provide geographical location information about a position of a transit vehicle in which the transit vehicle time table notification device is installed to the information handling device;

a time clock circuit that provides a time signal to the information handling device;

a door status sensor configured to provide a door open signal when a predetermined transit vehicle door is opened and a door close signal when the predetermined transit vehicle door is closed to the information handling device;

a telecommunication device configured to accept and transmit a transmit data package from the information handling device to a central controller, the telecommunication device further being configured to provide a received data package from the central controller to the information handling system;

wherein when the door status sensor transitions from providing the door closed signal to providing the door open signal at substantially the same time that the geographical location information is indicating that the transit vehicle is substantially close to the geographical location information of the selected transit stop name, then the information handling system provides a first transmit data package to the telecommunication device for transmission by the telecommunication device to the central controller, the first transmit data package comprises the selected transit stop name and an indication of the time that the transit vehicle arrived at the selected transit stop name.

23. The transit vehicle time table notification device of claim 22, wherein, after the transmit data package is transmitted by the telecommunication device, the telecommunication device is configured to receive a first data package from the central controller, the received first data package comprises an updated time estimation of when the transit vehicle will depart from the selected transit stop name.

24. The transit vehicle time table notification device of claim 22, wherein, after the transmit data package is transmitted by the telecommunication device and the door status sensor transitions from providing the door open signal to providing the door closed signal, the information handling system provides a second transmit data package to the telecommunication device for transmission by the telecommunication device to the central controller, the second transmit data package comprise the selected stop name and an indication of the time that the transit vehicle is departing the selected transit stop name.

25. The transit vehicle time table notification device of claim 24, wherein, after the second transmit package is transmitted by the telecommunication device, the telecommunication device is configured to receive a second data package from the central controller, the received second data package comprises an updated time estimation of when the transit vehicle will arrival at a next selected transit stop name to be provided by the information handling device for display to users of the transit system.

26. The transit vehicle time table notification device of claim 22, wherein the central controller comprises a data base and a microprocessor configured to organize and store indications of the times that the transit vehicle arrived at each of the N transit stop names in the data base; the microprocessor further configured to calculate the updated time estimation of when the transit vehicle will depart from the selected transit stop name.

27. The transit vehicle time table notification device of claim 23, wherein the central controller comprises a data base and microprocessor configured to organize and store indications of the times that the transit vehicle departed from each of the N transit stop names in the data base, the microprocessor further configured to calculate the updated time estimation of when the transit vehicle will arrival at a next selected transit stop name based on the stored indications of the times that the transit vehicle departed from the selected transit stop name.

28. The transit vehicle time table notification device of claim 27, wherein the time of arrival and time of departure data for each of the N transit stop names are further organized by at least the day of the week and the time of day.

* * * * *